US006201360B1

(12) United States Patent
Misonou

(10) Patent No.: US 6,201,360 B1
(45) Date of Patent: Mar. 13, 2001

(54) DEFLECTION YOKE AND CATHODE-RAY TUBE DEVICE

(75) Inventor: Takehiro Misonou, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 08/681,522

(22) Filed: Jul. 23, 1996

(51) Int. Cl.[7] ..... H01J 29/70; H01J 29/76
(52) U.S. Cl. ..... 315/400
(58) Field of Search ..... 315/400

(56) References Cited

U.S. PATENT DOCUMENTS 3,940,662 * 2/1976 Quirke ..... 315/400
5,260,627 * 11/1993 Yokota et al. ..... 315/400

* cited by examiner

*Primary Examiner*—Theodore M. Blum
(74) *Attorney, Agent, or Firm*—Ronald P. Kananen

(57) ABSTRACT

A deflection yoke has a horizontal deflection coil and a saturable reactor connected to the horizontal deflection coil. The inductance of the saturable reactor is variable depending on a horizontal deflecting current flowing through the horizontal deflection coil or a vertical deflecting current supplied to the deflection yoke for varying a field distribution of a deflecting magnetic field produced by the horizontal deflection coil depending on the horizontal deflecting current or the vertical deflecting current.

4 Claims, 8 Drawing Sheets

DEFLECTION YOKE AND CATHODE-RAY TUBE DEVICE

BACKGROUND OF THE INVENTION

The present invention relates to a deflection yoke and a cathode-ray tube device for use as a computer display unit, for example.

Heretofore, efforts have been made to reduce image distortions and misconvergence in cathode-ray tube devices for use as computer display units or the like by adjusting the winding distribution of deflection coils and correcting deflecting magnetic fields with an auxiliary coil.

Specifically, it is possible to reduce image distortions and misconvergence in a cathode-ray tube device simply by adjusting the field distributions of deflecting magnetic fields in order to produce different field distributions of horizontal and vertical deflecting magnetic fields at screen and neck regions of the cathode-ray tube device (see Japanese Patent Laid-open Nos. Hei 4-65489, Hei 4-39649, and Hei 5-39895).

If the field distributions of horizontal and vertical deflecting magnetic fields differ from each other at screen and neck regions of a cathode-ray tube device, however, a reversed pattern of misconvergence is produced on the display screen as shown in FIG. 1 of the accompanying drawings. In FIG. 1, "XH" represents an amount of misconvergence produced on a central line in left and right end areas of the display screen, "XH'" represents an amount of misconvergence produced in areas between the left and right end areas and the center of the display screen, and "S1", PQV represent amounts of misconvergence produced in upper and lower areas above and below the areas where the amounts of misconvergence "XH", "XH'" are measured.

In the upper and lower areas, red and blue patterns are vertically reversed as they go from the center of the display screen toward the left and right end areas thereof. Because of the reversed red and blue patterns, if misconvergence is reduced in some area of the display screen by changing the deflecting magnetic fields, then misconvergence is increased in another area of the display screen. For correcting the misconvergence by changing the deflecting magnetic fields, however, it is difficult to set the winding distributions of deflection coils to optimum values and also to adjust the deflection yoke.

To alleviate such a drawback, it has been customary for related art cathode-ray tube devices to incorporate an auxiliary coil in the deflection yoke near the electron guns. The auxiliary coil is energized by a horizontal deflecting current or a current from an external power supply. Alternatively, the auxiliary coil consists of a saturable reactor, and is modulated by a vertical deflecting current and energized by a horizontal deflecting current. The auxiliary coil is thus energized to correct the misconvergence which cannot fully be removed by the deflection yoke itself (see Japanese Patent Laid-open Nos. Sho 60-158534, Hei 5-1890, and Hei 5-15715).

However, use of the auxiliary coil separately mounted on the neck of the cathode-ray tube for convergence correction results in an increased number of parts of the cathode-ray tube device, which is therefore relatively complex in structure.

SUMMARY OF THE INVENTION

It is therefore an object of the present invention to provide a deflection yoke and a cathode-ray tube device which are capable of correcting convergence easily with a simple structure.

According to the present invention, there is provided a deflection yoke comprising a horizontal deflection coil, and a saturable reactor connected to the horizontal deflection coil, the saturable reactor having an inductance variable depending on a horizontal deflecting current flowing through the horizontal deflection coil or a vertical deflecting current supplied to the deflection yoke for varying a field distribution of a deflecting magnetic field produced by the horizontal deflection coil depending on the horizontal deflecting current or the vertical deflecting current.

According to the present invention, there is also provided a deflection yoke comprising a horizontal deflection coil comprising a plurality of deflection coil segments, and a saturable reactor connected to at least one of the deflection coil segments, the saturable reactor having an inductance variable depending on a horizontal deflecting current flowing through the horizontal deflection coil or a vertical deflecting current supplied to the deflection yoke for varying a ratio of currents flowing through the deflection coil segments depending on the horizontal deflecting current or the vertical deflecting current for thereby varying a field distribution of a deflecting magnetic field produced by the horizontal deflection coil depending on the horizontal deflecting current or the vertical deflecting current.

According to the present invention, there is also provided a deflection yoke comprising a pair of first and second horizontal deflection coils, the first horizontal deflection coil comprising a first pair of horizontal deflection coil segments connected parallel to each other, the second horizontal deflection coil comprising a second pair of horizontal deflection coil segments connected parallel to each other, the first pair of horizontal deflection coil segments being connected in series to the second pair of horizontal deflection coil segments, and a saturable reactor connected parallel to the first pair of horizontal deflection coil segments and connected in series to the second pair of horizontal deflection coil segments.

According to the present invention, there is also provided a deflection yoke comprising a pair of first and second horizontal deflection coils, the first horizontal deflection coil comprising a first pair of horizontal deflection coil segments connected parallel to each other, the second horizontal deflection coil comprising a second pair of horizontal deflection coil segments connected parallel to each other, the first pair of horizontal deflection coil segments being connected parallel to the second pair of horizontal deflection coil segments, and a saturable reactor connected in series to the first pair of horizontal deflection coil segments and connected parallel to the second pair of horizontal deflection coil segments.

According to the present invention, there is also provided a cathode-ray tube device comprising a deflection yoke comprising a horizontal deflection coil comprising a plurality of deflection coil segments, and a saturable reactor connected to at least one of the deflection coil segments, the saturable reactor having an inductance variable depending on a horizontal deflecting current flowing through the horizontal deflection coil or a vertical deflecting current supplied to the deflection yoke for varying a ratio of currents flowing through the deflection coil segments depending on the horizontal deflecting current or the vertical deflecting current for thereby varying a field distribution of a deflecting magnetic field produced by the horizontal deflection coil depending on the horizontal deflecting current or the vertical deflecting current.

According to the present invention, there is also provided a cathode-ray tube device comprising a deflection yoke comprising a pair of first and second horizontal deflection coils, the first horizontal deflection coil comprising a first pair of horizontal deflection coil segments connected parallel to each other, the second horizontal deflection coil comprising a second pair of horizontal deflection coil segments connected parallel to each other, the first pair of horizontal deflection coil segments being connected in series to the second pair of horizontal deflection coil segments, and a saturable reactor connected parallel to the first pair of horizontal deflection coil segments and connected in series to the second pair of horizontal deflection coil segments.

According to the present invention, there is also provided a cathode-ray tube device comprising a deflection yoke comprising a pair of first and second horizontal deflection coils, the first horizontal deflection coil comprising a first pair of horizontal deflection coil segments connected parallel to each other, the second horizontal deflection coil comprising a second pair of horizontal deflection coil segments connected parallel to each other, the first pair of horizontal deflection coil segments being connected parallel to the second pair of horizontal deflection coil segments, and a saturable reactor connected in series to the first pair of horizontal deflection coil segments and connected parallel to the second pair of horizontal deflection coil segments.

With the above arrangement, a pattern of misconvergence is uniformly produced by the deflection yoke, and hence can easily be corrected with a simple structure.

DETAILED DESCRIPTION OF THE PREFERRED EMBODIMENTS

Figure 1:
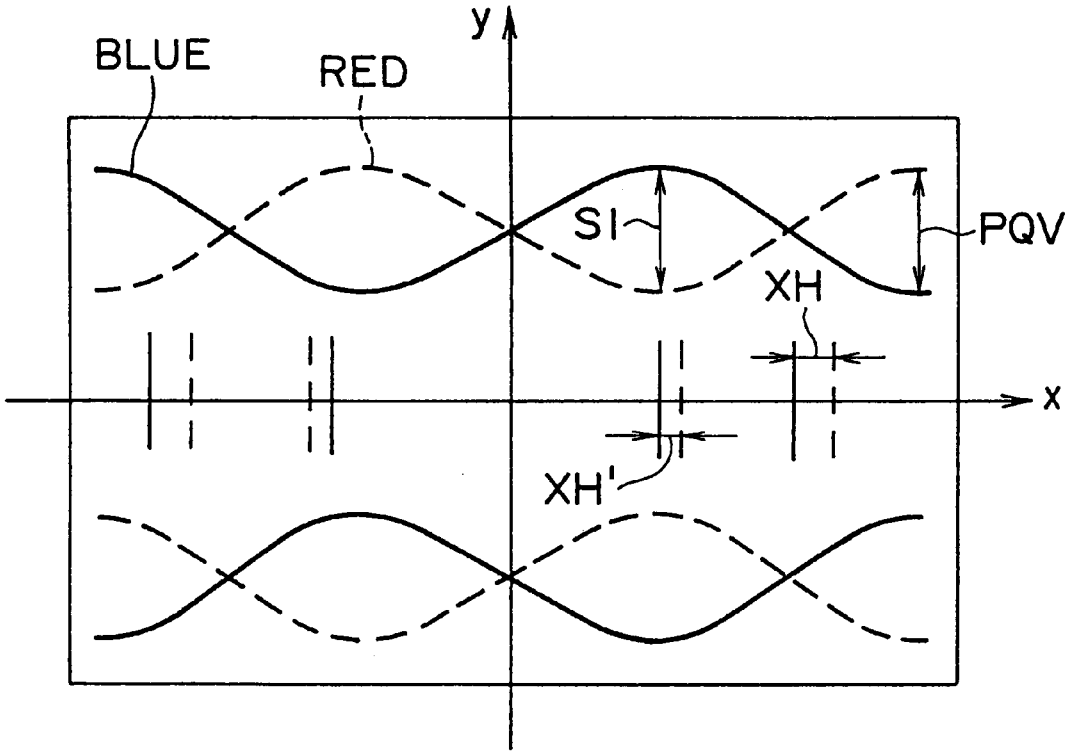
FIG. 1 is a diagram showing a reversed pattern of misconvergence produced by a related art deflection yoke.
Figure 2:
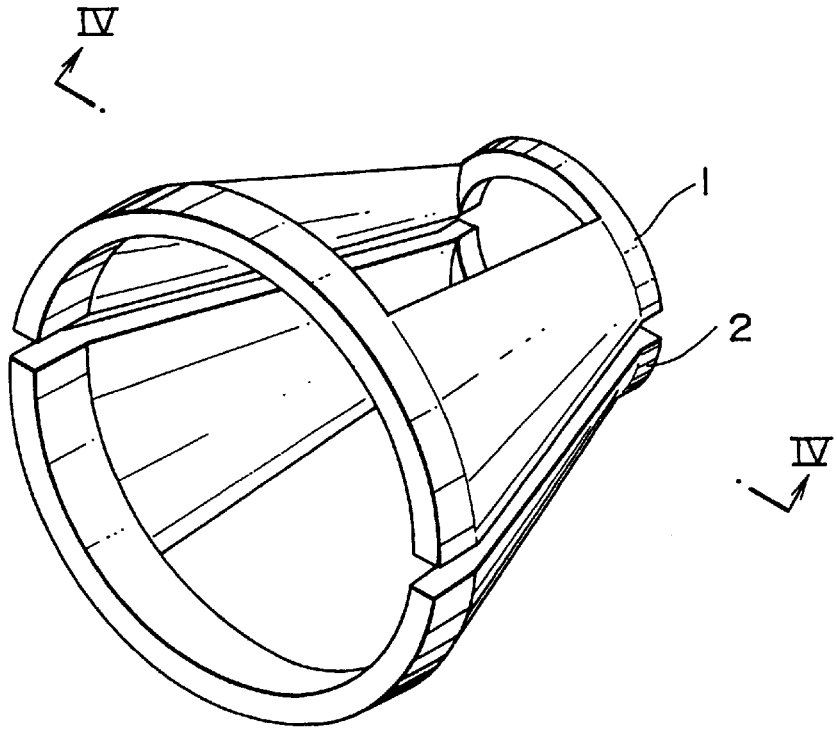
FIG. 2 is a perspective view of a pair of horizontal deflection coils of a deflection yoke according to an embodiment of the present invention.

FIG. 2 shows in perspective a pair of horizontal deflection coils 1, 2 of a deflection yoke according to an embodiment of the present invention. The horizontal deflection coils 1, 2 can be fabricated by winding magnet wires on a horizontal coil separator (not shown). A core with a vertical deflection coil wound thereon is mounted on the horizontal coil separator with the horizontal deflection coils 1, 2 wound thereon, and therafter front and rear covers are attached to them, thereby completing a deflection yoke.

The horizontal coil separator for winding the horizontal deflection coils 1, 2 thereon is of a substantially funnel-shaped structure having an inner wall surface complementary in shape to the profile of the horizontal deflection coils 1, 2. The horizontal coil separator has a plurality of grooves defined in the inner wall surface and a plurality of fingers on upper and lower ends thereof in alignment with the grooves. The magnet wires are wound as sectionalized windings on the horizontal coil separator using the grooves and the fingers.

Specifically, the horizontal deflection coils 1, 2 are wound by a coil winder. When the coil winder has wound a predetermined number of turns of the magnet wires on the horizontal coil separator, the coil winder pulls the magnet wires out of the horizontal coil separator, and thereafter starts winding the magnet wires on the horizontal coil separator. In this manner, each of the horizontal deflection coils 1, 2 is divided into two windings divided by the position where the coil winder has pulled the magnet wires out of the horizontal coil separator.

Figure 3:
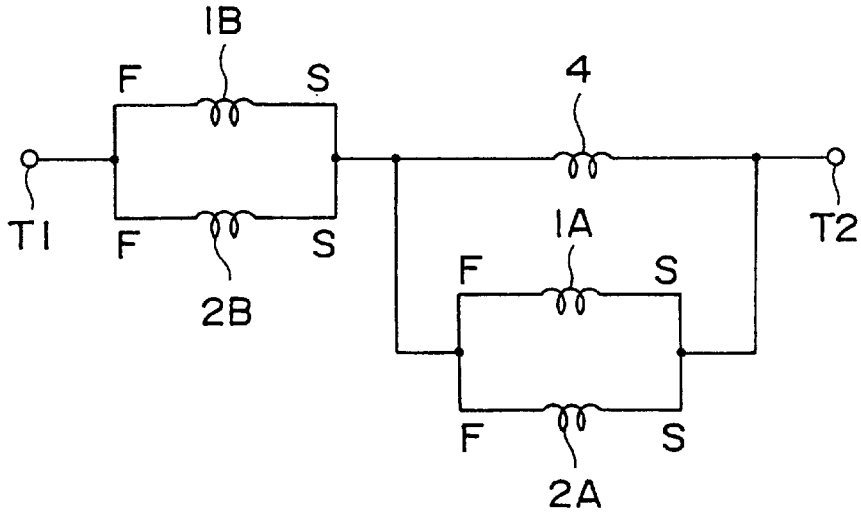
FIG. 3 is a circuit diagram of the horizontal deflection coils shown in FIG. 2.
Figure 4:
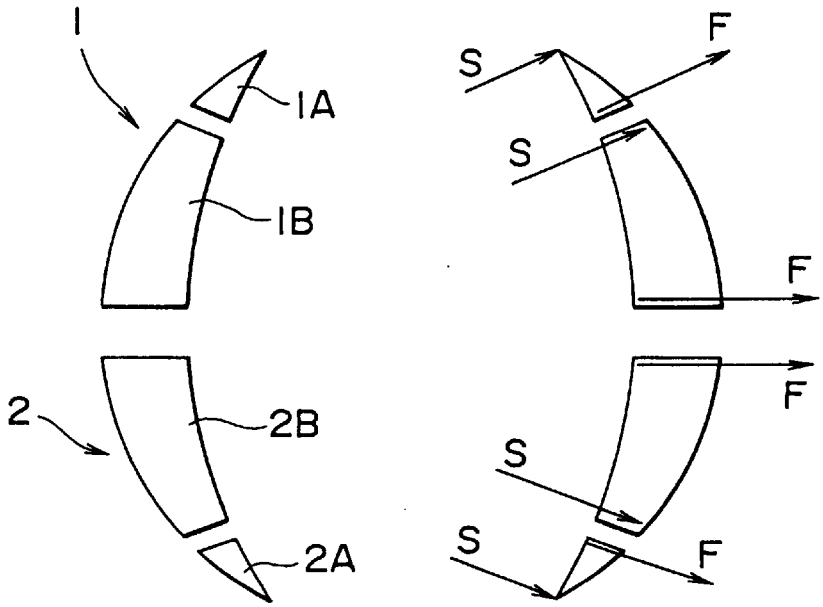
FIG. 4 is a cross-sectional view taken along line IV—IV of FIG. 2.

As shown in FIGS. 3 and 4, the horizontal deflection coils 1, 2 are divided into a pair of respective upper and lower smaller windings 1A, 2A corresponding to upper and lower areas of the display screen of a cathode-ray tube device which incorporates the deflection yoke, and a pair of respective central larger windings 1B, 2B corresponding to a central area of the display screen. These divided windings 1A, 2A, 1B, 2B will hereafter be referred to as horizontal deflection coil segments 1A, 2A, 1B, 2B, respectively. In FIGS. 3 and 4, "S" and "F" represent a start of the winding and an end of the winding, respectively.

The horizontal deflection coils 1, 2 thus fabricated are assembled as follows: As shown in FIG. 3, the upper and lower horizontal deflection coil segments 1A, 2A are connected parallel to each other and also to a terminal T1 on the rear cover of the deflection yoke, and the central horizontal deflection coil segments 1B, 2B are connected parallel to each other and also to a terminal T2 on the rear cover. The parallel-connected central horizontal deflection coil segments 1B, 2B are then connected parallel to a saturable reactor 4, and thereafter connected in series to the parallel-connected upper and lower horizontal deflection coil segments 1A, 2A.

Figure 5:
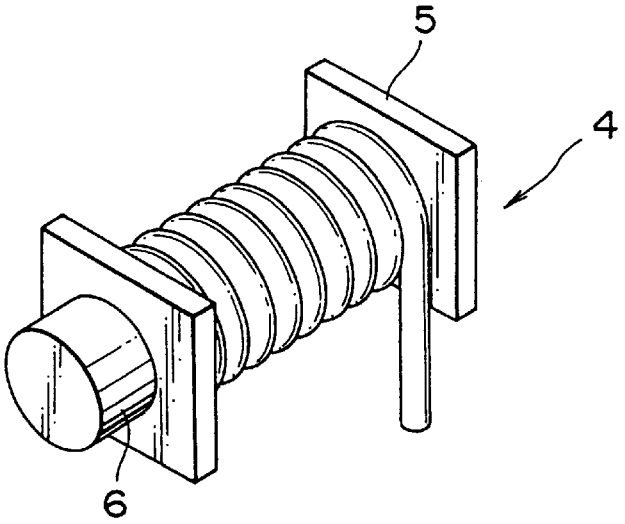
FIG. 5 is a perspective view of a saturable reactor connected to the horizontal deflection coils shown in FIG. 2.

The saturable reactor 4 is mounted on the rear cover together with a terminal block of the terminal T1. As shown in FIG. 5, the saturable reactor 4 consists of a cylindrical coil bobbin 5 with rectangular flanges mounted on opposited ends thereof, a magnet wire wound around the cylindrical coil bobbin 5 between the rectangular flanges, and a ferrite core 6 threaded into the cylindrical coil bobbin 5. The core 6 is of a cylidrical shape with an externally threaded outer circumferential surface, which is held in threaded engagement with an internally threaded inner circumferential surface of the cylindrical coil bobbin 5.

Figure 6:
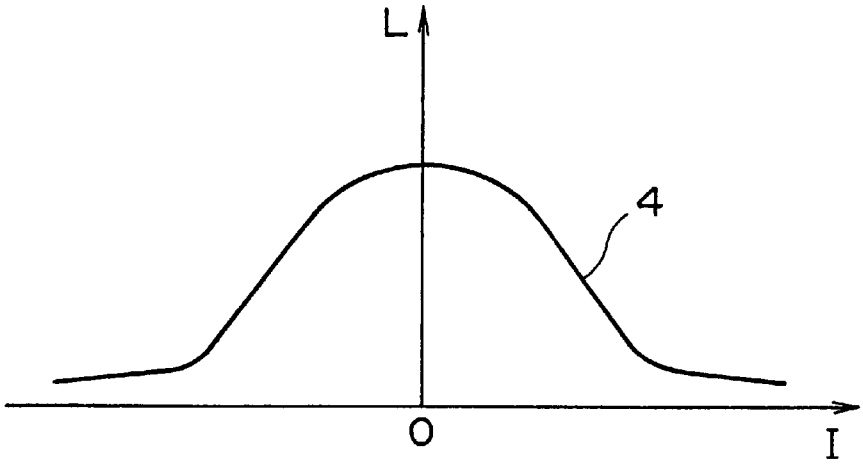
FIG. 6 is a diagram showing the inductance characteristic of the saturable reactor shown in FIG. 5.

The number of turns of the magnet wire on the cylindrical coil bobbin 5 is selected with respect to the saturation flux density of the core 6 to cause the saturable reactor 4 to exhibit a saturation characteristic curve as shown in FIG. 6 with respect to a horizontal deflecting current I which flows through the saturable reactor 4. Specifically, as shown in FIG. 6, the saturable reactor 4 exhibits a sufficiently large inductance L determined by the number of turns of the magnet wire and the core 6 in a range in which the absolute value of the horizontal deflecting current I is smaller, i.e., a central area of the display screen, and a largely reduced inductance L in ranges in which the absolute value of the horizontal deflecting current I is larger, i.e., opposite side areas of the display screen, because of the saturation of the core 6.

As the inductance L of the saturable reactor 4 decreases, the horizontal deflecting current flowing through the upper and lower horizontal deflection coil segments 1A, 2A of the horizontal deflection coils 1, 2 is reduced, with the result that the characteristics of the central horizontal deflection coil segments 1B, 2B become more prevalent. Consequently, the field distribution of a magnetic field generated by the horizontal deflection coils 1, 2 represents a greater tendency toward a pincushion-shaped magnetic field.

As the inductance L of the saturable reactor 4 increases, the horizontal deflecting current flowing through the upper and lower horizontal deflection coil segments 1A, 2A is increased, with the result that the characteristics of the horizontal deflection coils 1, 2 with the saturable reactor 4 removed become more prevalent. Consequently, the field distribution of a magnetic field generated by the horizontal deflection coils 1, 2 represents a smaller tendency toward a pincushion-shaped magnetic field.

Figure 7:
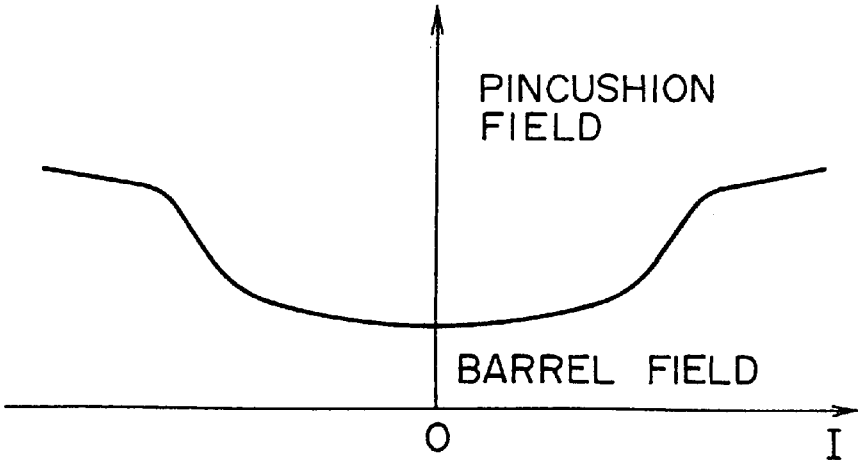
FIG. 7 is a diagram showing a deflecting magnetic field produced by the horizontal deflection coils shown in FIG. 2.

As shown in FIG. 7, the field distribution of the deflection yoke varies depending on the horizontal deflecting current I. The winding distributions of the horizontal deflection coils 1, 2 and the positions where the magnet wires are pulled out of the horizontal coil separator are selected such that the deflection yoke generates a barrel-shaped magnetic field in a range in which the absolute value of the horizontal deflecting current I is smaller, and the deflection yoke generates a pincushion-shaped magnetic field in a range in which the absolute value of the horizontal deflecting current I is larger. Accordingly, the field distribution of a deflecting magnetic field produced by the deflection yoke is variable depending on the horizontal deflecting current I.

Consequently, the field distribution of a deflecting magnetic field produced by the deflection yoke can be selected freely by selecting the winding distributions of the horizontal deflection coils 1, 2, the positions where the magnet wires are pulled out of the horizontal coil separator, and the characteristics of the saturable reactor 4. The field distribution of the deflection yoke can thus be varied with a simple structure for easily correcting misconvergence in the cathode-ray tube device.

Figure 8:
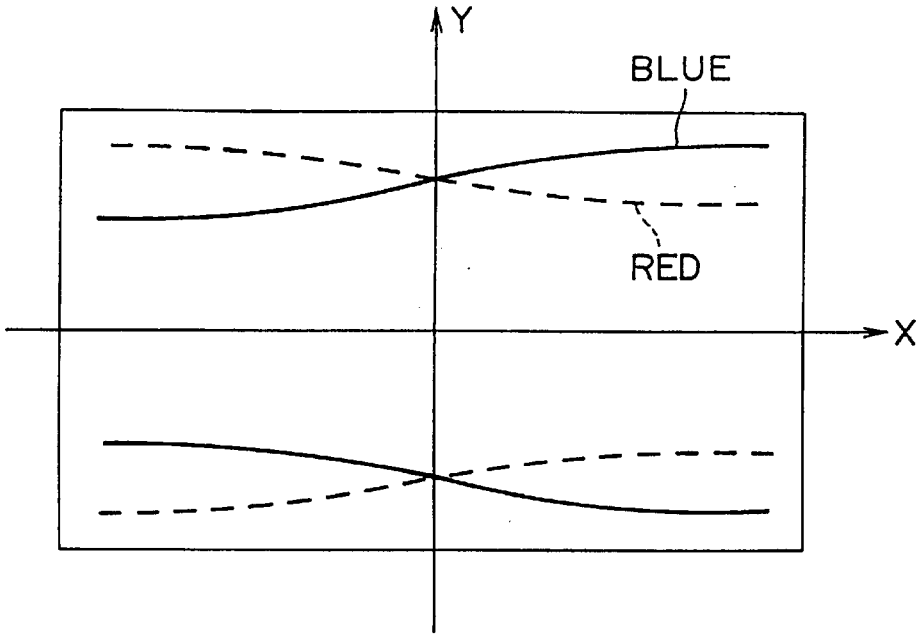
FIG. 8 is a diagram showing a pattern of misconvergence produced by the horizontal deflection coils shown in FIG. 2.

FIG. 8 shows a pattern of misconvergence which is produced by the horizontal deflection coils 1, 2 shown in FIG. 2 when the field distribution is varied depending on the horizontal deflecting current. According to the illustrated pattern of misconvergence, the amount of misconvergence varies uniformly horizontally from the center toward the left and right end areas of the display screen. Consequently, the amount of misconvergence can easily and reliably be minimized on the display screen by selecting the winding distribution and the other factors.

As described above, the horizontal deflection coils 1, 2 of the deflection yoke are produced by winding magnet wires on the horizontal coil separator, as sectionalized windings in the form of the upper and lower horizontal deflection coil segments 1A, 2A corresponding to upper and lower areas of the display screen and the central horizontal deflection coil segments 1B, 2B corresponding to a central area of the display screen. Then, the upper and lower horizontal deflection coil segments 1A, 2A are connected parallel to each other, and the central horizontal deflection coil segments 1B, 2B are connected parallel to each other. The parallel-connected central horizontal deflection coil segments 1B, 2B are then connected parallel to the saturable reactor 4, and thereafter connected in series to the parallel-connected upper and lower horizontal deflection coil segments 1A, 2A.

In operation, a horizontal deflecting current is supplied to the horizontal deflection coils 1, 2. When the absolute value of the horizontal deflecting current I is smaller, i.e., in the central area of the display screen, the upper and lower horizontal deflection coil segments 1A, 2A and the central horizontal deflection coil segments 1B, 2B jointly produce a barrel-shaped magnetic field. When the absolute value of the horizontal deflecting current I is larger, i.e., in the opposite end areas of the display screen, the saturable reactor 4 is saturated, reducing the current flowing through the upper and lower horizontal deflection coil segments 1A, 2A, and the central horizontal deflection coil segments 1B, 2B become more effective to produce a pincushion-shaped magnetic field. As a result, image distortions on the display screen can effectively be reduced for convergence correction.

Since the horizontal deflection coils 1, 2 are divided into horizontal deflection coil segments 1A, 2A, 1B, 2B and the saturable reactor 4 is connected thereto for varying the field distribution of a horizontal deflecting magneic field depending on the horizontal deflecting current supplied to the horizontal deflection coils 1, 2, misconvergence can easily and accurately be corrected with a simple structure.

In the above embodiment, the horizontal deflection coils 1, 2 are divided into the upper and lower horizontal deflection coil segments 1A, 2A corresponding to upper and lower areas of the display screen and the central horizontal deflection coil segments 1B, 2B corresponding to a central area of the display screen. However, the horizontal deflection coils 1, 2 may be divided into a desired number of horizontal deflection coil segments at various desired positions.

Figure 9:
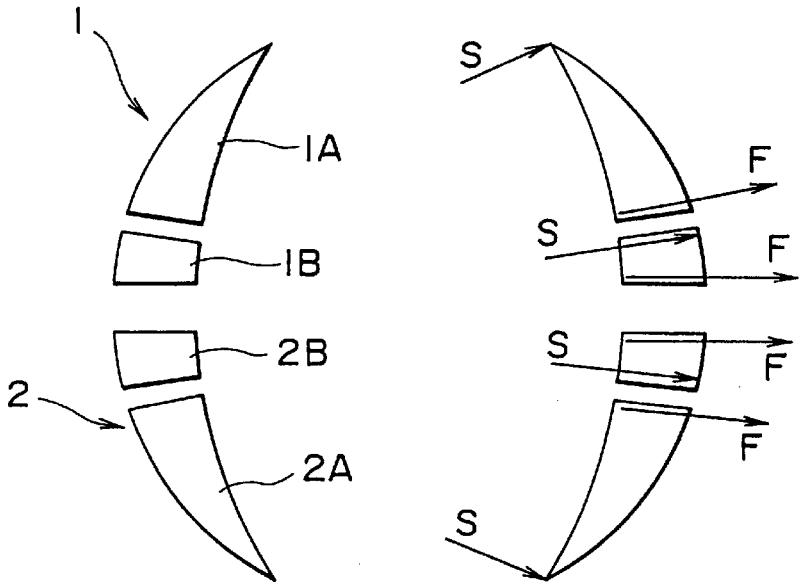
FIG. 9 is a cross-sectional view of a pair of horizontal deflection coils of a deflection yoke according to another embodiment of the present invention.

FIG. 9 shows a pair of horizontal deflection coils 1, 2 of a deflection yoke according to another embodiment of the present invention. In FIG. 9, the horizontal deflection coils 1, 2 are divided into a pair of respective upper and lower larger horizontal deflection coil segments 1A, 2A corresponding to upper and lower areas of the display screen of the cathode-ray tube device, and a pair of respective central smaller horizontal deflection coil segments 1B, 2B corresponding to a central area of the display screen.

If the horizontal deflection coils 1, 2 shown in FIG. 9 are connected as shown in FIG. 3, then they produce a deflecting magnetic field composed of pincushion-shaped and barrel-shaped fields that are a reversal of those shown in FIG. 7, depending on the horizontal deflecting current. Alternatively, the horizontal deflection coil segments 1A, 2A and the horizontal deflection coil segments 1B, 2B shown in FIG. 9 may be switched around to produce the deflecting magnetic field shown in FIG. 7.

In the above embodiment, the parallel-connected horizontal deflection coil segments 1A, 2A and the parallel-connected horizontal deflection coil segments 1B, 2B are connected in series to each other, and the saturable reactor 4 is connected parallel to the horizontal deflection coil segments 1A, 2A. However, the horizontal deflection coil segments 1A, 2A and the horizontal deflection coil segments 1B, 2B may be connected in any of various patterns as desired or depending on how the horizontal deflection coils are divided.

Figure 10:
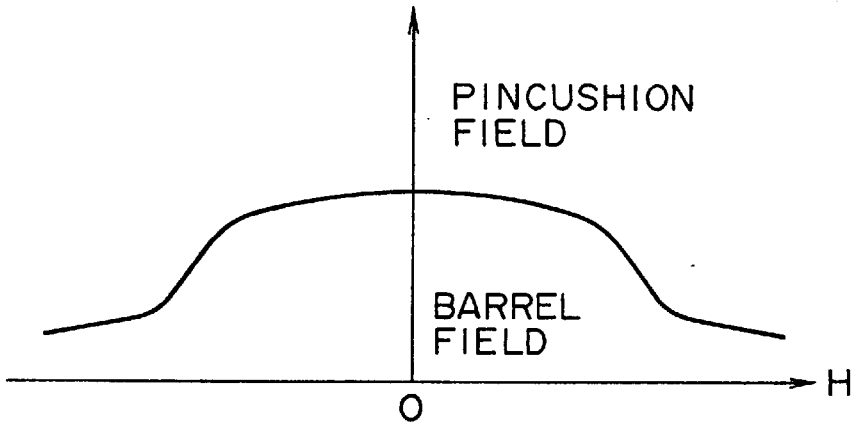
FIG. 10 is a diagram showing a deflecting magnetic field produced by the horizontal deflection coils shown in FIG. 9 which are connected as shown in FIG. 3.
Figure 11:
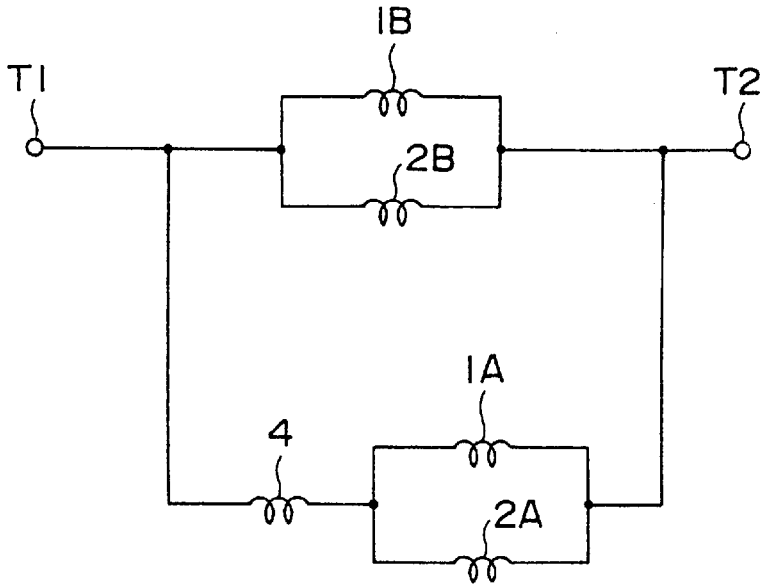
FIG. 11 is a circuit diagram of a pair of horizontal deflection coils of a deflection yoke according to still another embodiment of the present invention.
Figure 12:
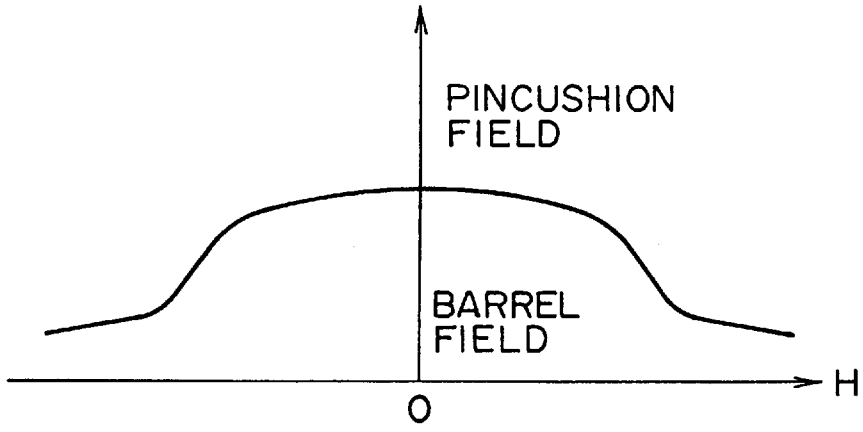
FIG. 12 is a diagram showing a deflecting magnetic field produced by the horizontal deflection coils shown in FIG. 2 which are connected as shown in FIG. 11.

FIG. 11 shows a pair of horizontal deflection coils 1, 2 of a deflection yoke according to still another embodiment of the present invention. In FIG. 11, the horizontal deflection coils 1, 2 are divided into respective horizontal deflection coil segments 1A, 2A connected parallel to each other and respective horizontal deflection coil segments 1B, 2B connected parallel to each other. A saturable reactor 4 is connected in series to the parallel-connected horizontal deflection coil segments 1A, 2A, and the parallel-connected horizontal deflection coil segments 1B, 2B are connected parallel to the series-connected circuit of the saturable reactor 4 and the parallel-connected horizontal deflection coil segments 1A, 2A. The deflection yoke thus connected as shown in FIG. 11 produces the deflecting magnetic field as that shown in FIG. 10, as shown in FIG. 12.

Figure 13:
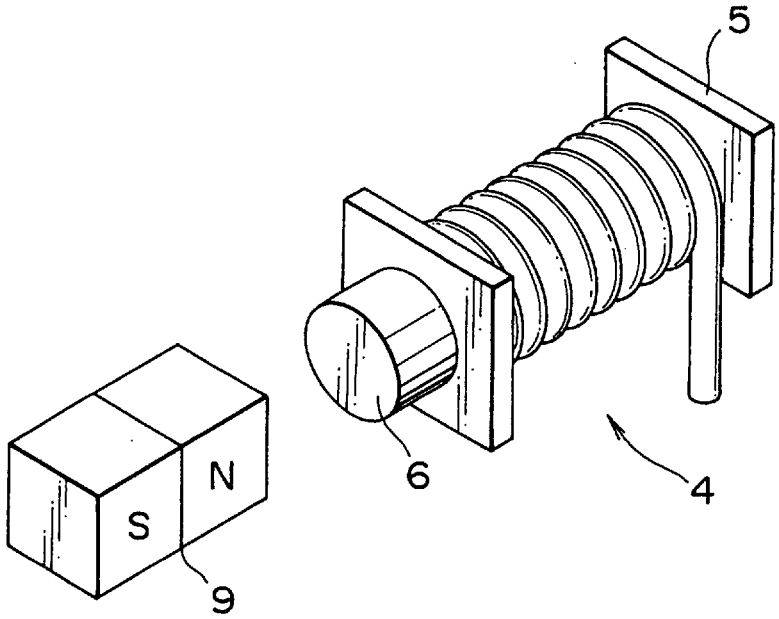
FIG. 13 is a perspective view of a saturable reactor according to another embodiment of the present invention.

FIG. 13 shows a saturable reactor 4 according to another embodiment of the present invention. The saturable reactor 4 shown in FIG. 13 is similar to the saturable reactor 4 shown in FIG. 5 except that a permanent magnet 9 is positioned closely to the core 6 for biasing the core 6.

Figure 14:
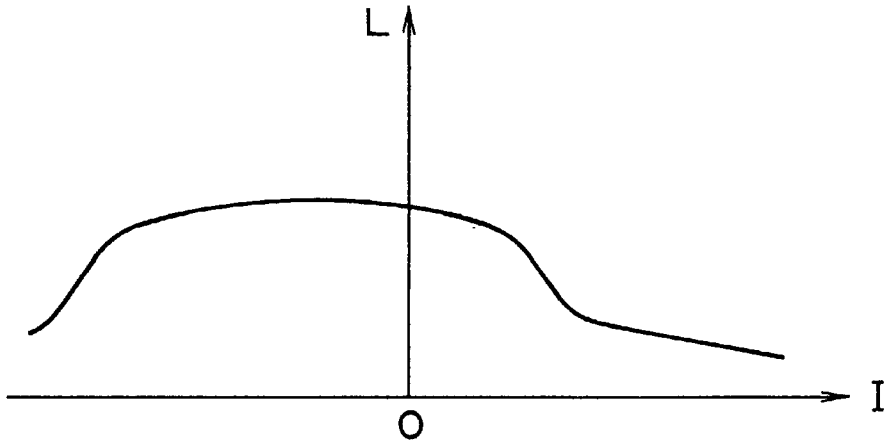
FIG. 14 is a diagram showing the inductance characteristic of the saturable reactor shown in FIG. 13.
Figure 15:
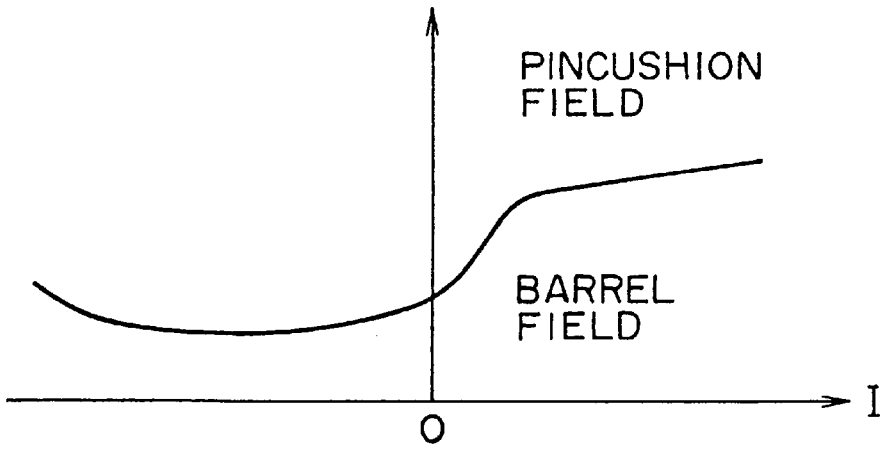
FIG. 15 is a diagram showing a deflecting magnetic field produced when the saturable reactor shown in FIG. 13 is used.

By biasing the core 6 with the permanent magnet 9, it is possible to shift the characterstic curve of the saturable reactor 4 with respect to the horizontal deflecting current as shown in FIG. 14. As a result, the center of the field distribution of the deflection yoke can be moved as shown in FIG. 15. Consequently, the permanent magnet 9 is effective to correct variations of the characteristics of the deflection yoke.

In the above embodiments, only one saturable reactor is employed in the deflection yoke. However, the horizontal deflection coils 1, 2 may be combined with respective saturable reactors, which may further be combined with respective permanent magnets for simplified correction or adjustment of the characteristics of the deflection yoke.

If each of the horizontal deflection coils 1, 2 is divided into a greater number of horizontal deflection coil segments, then the number of saturable reactors may also be increased correspondingly.

The saturable reactor may have an additional winding, and a vertical deflecting current may be supplied to the additional winding to control the field distribution of the horizontal deflecting magnetic field with the vertical deflecting current.

In the above embodiment, the saturable reactor 4 is mounted on the rear cover. However, the saturable reactor 4 may be mounted on the circuit board of the cathode-ray tube device to avoid an undue increase in the number of different types of deflection yokes, and hence the inventory control of deflection yokes is simplified.

Although certain preferred embodiments of the present invention have been shown and described in detail, it should be understood that various changes and modifications may be made therein without departing from the scope of the appended claims.

What is claimed is:

1. A deflection yoke, comprising:

a horizontal deflection coil and a saturable reactor connected to said horizontal deflection coil, said saturable reactor having an inductance variable depending on a horizontal deflecting current flowing through said horizontal deflection coil or a vertical deflecting current supplied to the deflection yoke for varying a field distribution of a deflecting magnetic field produced by said horizontal deflection coil depending on said horizontal deflecting current or said vertical deflecting current, wherein said horizontal deflection coil has a pair of first and second horizontal deflection coils, said first horizontal deflection coil comprising a first pair of horizontal deflection coil segments connected parallel to each other, said second horizontal deflection coil comprising a second pair of horizontal deflection coil segments connected parallel to each other, said first pair of horizontal deflection coil segments being connected in series to said second pair of horizontal deflection coil segments; and wherein said saturable reactor is connected parallel to said first pair of horizontal deflection coil segments.

2. A deflection yoke, comprising:

a horizontal deflection coil and a saturable reactor connected to said horizontal deflection coil, said saturable reactor having an inductance variable depending on a horizontal deflecting current flowing through said horizontal deflection coil or a vertical deflecting current supplied to the deflection yoke for varying a field distribution of a deflecting magnetic field produced by said horizontal deflection coil depending on said horizontal deflecting current or said vertical deflecting current, wherein said horizontal deflection coil has a pair of first and second horizontal deflection coils, said first horizontal deflection coil comprising a first pair of horizontal deflection coil segments connected parallel to each other, said second horizontal deflection coil comprising a second pair of horizontal deflection coil segments connected parallel to each other; and wherein said saturable reactor is connected in series to said first pair of horizontal deflection coil segments and connected parallel to said second pair of horizontal deflection coil segments, said series connection of said saturable reactor and said first pair of horizontal deflection coil segments being parallel to said second pair of horizontal deflection coil segments.

3. A cathode-ray rube device comprising a deflection yoke comprising a horizontal deflection coil and a saturable reactor connected to said horizontal deflection coil, wherein said horizontal deflection coil has a pair of first and second horizontal deflection coils, said first horizontal deflection coil comprising a first pair of horizontal deflection coil segments connected parallel to each other, said second horizontal deflection coil comprising a second pair of horizontal deflection coil segments connected parallel to each other, said first pair of horizontal deflection coil segments being connected in series to said second pair of horizontal deflection coil segments; and wherein said saturable reactor is connected parallel to said first pair of horizontal deflection coil segments, said saturable reactor having an inductance variable depending on a horizontal deflecting current flowing through said horizontal deflection coil or a vertical deflecting current supplied to the deflection yoke for varying a ratio of currents flowing through said deflection coil segments depending on said horizontal deflecting current or said vertical deflecting current for thereby varying a field distribution of a deflecting magnetic field produced by said horizontal deflection coil depending on said horizontal deflecting current or said vertical deflecting current.

4. A cathode-ray rube device comprising a deflection voke comprising a horizontal deflection coil and a saturable reactor connected to said horizontal deflection coil, wherein said horizontal deflection coil has a pair of first and second horizontal deflection coils, said first horizontal deflection coil comprising a first pair of horizontal deflection coil segments connected parallel to each other, said second horizontal deflection coil comprising a second pair of horizontal deflection coil segments connected parallel to each other; and wherein said saturable reactor is connected in series to said first pair of horizontal deflection coil segments, said series connection of said saturable reactor and said first pair of horizontal deflection coil segments being parallel to said second pair of horizontal deflection coil segments, said saturable reactor having an inductance variable depending on a horizontal deflecting current flowing through said horizontal deflection coil or a vertical deflecting current supplied to the deflection yoke for varying a ratio of currents flowing through said deflection coil segments depending on said horizontal deflecting current or said vertical deflecting current for thereby varying a field distribution of a deflecting magnetic field produced by said horizontal deflection coil depending on said horizontal deflecting current or said vertical deflecting current.

* * * * *

UNITED STATES PATENT AND TRADEMARK OFFICE

CERTIFICATE OF CORRECTION

PATENT NO. : 6,201,360 B1
DATED : March 13, 2001
INVENTOR(S) : Takehiro Misonou

It is certified that error appears in the above-identified patent and that said Letters Patent is hereby corrected as shown below:

Column 9, claim 4,
Line 6, change [rube] to "tube" and change [voke] to "yoke".

Signed and Sealed this

Eighth Day of January, 2002

*Attest:*

*Attesting Officer*

JAMES E. ROGAN
*Director of the United States Patent and Trademark Office*